US007070470B2

(12) United States Patent
Bleicken

(10) Patent No.: US 7,070,470 B2
(45) Date of Patent: Jul. 4, 2006

(54) BOW-FACING ROWING SYSTEM

(76) Inventor: Eric Vaughn Bleicken, 170 B Pleasant St., South Yarmouth, MA (US) 02664

( * ) Notice: Subject to any disclaimer, the term of this patent is extended or adjusted under 35 U.S.C. 154(b) by 0 days.

(21) Appl. No.: 10/669,407

(22) Filed: Sep. 25, 2003

(65) Prior Publication Data

US 2005/0070181 A1 Mar. 31, 2005

(51) Int. Cl.
*B63H 16/06* (2006.01)

(52) U.S. Cl. ..... 440/105; 440/103

(58) Field of Classification Search ..... 440/101, 440/102, 103, 104, 105
See application file for complete search history.

(56) References Cited

U.S. PATENT DOCUMENTS 4,867,719 A * 9/1989 duPont ..... 440/101
4,943,250 A * 7/1990 DuPont ..... 440/101

* cited by examiner

*Primary Examiner*—Stephen Avila

(57) ABSTRACT

A rowing device with articulating oars FIG. 4 that are connected to outriggers FIG. 1 at the point of articulation. While the rower sits on a fixed seat 6, said outriggers 4 are foot operated 2 and function in the opposite direction as the feet through a system of cables 12 and sheaves 11.

28 Claims, 6 Drawing Sheets

CROSS SECTION

FOOT OPERATED OUTRIGGER DRIVE MECHANISM

FOOTPAD / OUTRIGGER CABLE SYSTEM

ELEVATION & SWING MECHANISM

OAR ARTICULATING HINGE

DOGGING MECHANISM

BOW-FACING ROWING SYSTEM

CROSS REFERENCE TO RELATED APPLICATIONS

U.S. Cl. 416, subclass 74
U.S. Cl. 440, subclasses 101, 102, 103, 104, 105
U.S. Cl. D12, subclass 215 and 317
References Cited:

| | | |
|---|---|---|
| Articulating Oar Gearing | | |
| 1,609,330 | 7/12/1926 | Thibodeau |
| 1,120,944 | 15/12/1914 | Koble |
| 2,033,637 | 10/3/1936 | Kaiser |
| 2,565,714 | 28/8/1951 | Anderson |
| 5,112,261 | 12/4/1992 | Humphrey |
| 6,113,447 | 9/5/2000 | Roy et. al. |
| 4,738,643 | 4/19/1988 | Noggle |
| 0,517,999 | 10/5/1894 | Burns |
| 0,355,879 | 11/1/1887 | McGee |
| D252,625 | 14/8/1979 | White |
| D235,865 | 15/7/1975 | Bellis |
| 6,083,066 | 4/7/2000 | Wright |
| 4,943,250 | 6/1990 | duPont |
| Outrigger-Foot Operated | | |
| 89,663 | 5/1869 | Heroux |
| 5,647,782 | 6/15/1997 | Henry |
| 5,215,482 | 1/1/1993 | Henry |
| 4,889,509 | 26/12/1989 | Pohlus |
| 5,685,750 | 11/11/1997 | Rantilla |
| 6,109,988 | 29/8/2000 | Dunn, Jr. |
| 4,867,719 | 19/9/1989 | duPont |
| 4,383,830 | 17/5/1983 | Cartwright |
| 3,828,212 | 8/16/1988 | KrollPfeifer |
| 2,101,946 (UK) | 28/1/83 | Waugh et. al. |
| 2,099,773 (UK) | 5/6/1981 | Wolloner |
| Auto-feathering Blade | | |
| 4,943,250 | 24/7/1990 | duPont |
| 5,248,272 | 28/9/1993 | duPont |
| 3,215,482 | 24/4/1973 | Trull |
| 2,209,723 (UK) | 9/8/1988 | Witchell |
| 4,406,438 (Germany) | 11/9/1987 | Fischer |

STATEMENT REGARDING FEDERAL SPONSORED R&D

None

BACKGROUND OF THE INVENTION

Discussion of Prior Art

Forward facing rowing systems have historically either used an articulating oar or fixed the inboard end of the oar to a stanchion or vertical support. A few of the inventions listed above have utilized feet to move outriggers instead of the commonly used sliding seat. There are also a few forward facing rowing systems that incorporated blade-feathering devices. Additionally there are traditional rear facing rowing systems that have foot-operated outriggers. However no prior invention integrates a solution to facing forward, feathering the oar and foot driven outriggers Articulating Oar Systems that fix the inboard end of the oar are not relevant to this discussion. Most of the articulating oars listed above have not made an accommodation for feathering the blade on return from the power stroke. This is an awkward and largely unusable approach in recreational and racing rowboats where skimming the surface with a feathered oar on the return stroke adds stability and reduces resistance from wind and wave. Those inventions listed above that do not provide feathering are obviously inferior and a detailed discussion is unnecessary.

Noggle U.S. Pat. No. 4,738,643 comes closest to addressing the feathering problem but offers a complex and necessarily expensive system of gears. It appears that the rotation of the handgrip will erroneously rotate the blade in the same direction. Because the oar articulates it is necessary to rotate the blade in the opposite direction as the handgrip.

Dupont U.S. Pat. Nos. 4,943,250 and 4,867,719 approach the feathering issue with a vertical hydrofoil where the angle of the foil changes throughout the radius of the stroke. The Dupont design uses control rods and a complex system of levers that is likely to be heavy and cumbersome, and exhibit racking problems under load. Dupont's U.S. Pat. No. 4,867,719 utilizes a moving outrigger while his U.S. Pat. No. 4,943,250 uses a sliding seat.

Dupont U.S. Pat. No. 5,248,272 incorporates hollow tubes for the two parts of the articulating oar and a rotating inner shaft that is geared at the point of articulation to facilitate feathering of the oar's blade.

Trull U.S. Pat. No. 3,729,369 uses a system of levers and a camming mechanism to automatically feather the oar, however there appears to be no way to lock the blade in the power position for reverse or maneuvering strokes.

Fischer 4,406,438 (Germany) also incorporates an auto feathering mechanism that allows the blade end of the oar to rotate a flattened side of the oar shaft against a flattened vertical portion of the oarlock.

Foot Operated Outrigger

Today's racing sculls and shells as well as recreational and exercise rowboats use a sliding seat. This is a simple device that rides on two tracks and allows the rower to use his arms, back abdomen and leg muscles. A few of the above listed patents offer outriggers that slide instead of the rower's seat.

Heroux 89,663 uses a conventional oar with a solid shaft and uses foot power through a system of pulleys to aid the hands in pulling.

Like Heroux, Cartwright U.S. Pat. No. 4,383,830 is a conventional rear facing rowing system but it uses a system of levers to cause the outrigger to swing with a foot-activated mechanism while the seat remains stationary.

Pohlus, U.S. Pat. No. 4,889,509 and Wolloner 2,099,773 (UK) are similar foot operated sliding outriggers for a conventional rear facing rowing (racing) device. All of the foot-operated outriggers simply move the feet instead of the seat. None are configured to work with a forward-facing rowing system that requires the outrigger to move counter to the movement of the feet.

Object and Advantages

The object of the Bow-Facing Rowing System is to provide an improved forward facing means to row a shorter, low-volume boat that will provide the recreational and exercise rower with a simple, low-maintenance, car-top boat.

The Bow-Facing Rowing System allows the operators weight to remain at a fixed point in the boat and still have essentially the same arm/leg/back motions that would be found in a conventional sliding-seat rowing system. A disadvantage of the sliding seat and the resulting shifting weight forward and backward is that the boat tends to porpoise, or dive and bob, with the moving center of gravity. This porpoising has been traditionally offset by the production of very long boats (26 feet). By fixing the operators seat and moving the legs instead, the same rowing motions are executed but the porpoising problem is resolved and a true car top boat (16 feet) can be built to better satisfy the needs of the recreational rower.

A rowboat naturally moves faster through the water during the power stroke and slower during the return stroke. With a sliding seat rowing system there is a second factor involved. The rower is generally much heavier than the rowboat. As a result, his/her momentum tends to move steadily and the rowboat experiences positive and negative accelerations do to the shifting weight. With the proposed fixed-seat/sliding-feet concept, the boat and rower will act as a single mass and reduce those accelerations.

With prior articulating oars that use a fixed outrigger, the distance from the oarlock to the blade scribes a radius through the water causing much of the rowers work to be spent in pushing water away from the hull (at the beginning) and toward the hull (at the end) of each stroke. By contrast, the Bow-Facing Rowing System's moving outrigger causes the path of the oar's blade to move in a shallow arch that utilizes nearly all of the rower's power to propel the craft, thus improving the efficiency of the stroke.

In a conventional system it is common practice for the handgrips of the oars to extend past each other, thus requiring the rower to cross one arm over the other. This allows for increased leverage from the handgrip to the oarlock but an awkward rowing motion. The Bow-Facing Rowing System's articulating hinge provides that same leverage without having to extend the handles past each other simply by changing the gear ratio in the articulating hinge.

Traditional sliding seat systems pit arm and back muscles against the more powerful leg muscles. Rowers normally complete the leg extension at the beginning of the stroke followed by the arm and back portion of the stroke. The Bow-Facing Rowing System's separates these muscle group functions in a unique way that allows balancing of the arm/back motion with the leg motion thus allowing them to happen simultaneously. This results in a shorter time period for the completion of each stroke. Because the stronger leg muscles are used more of the time the Bow-Facing Rowing System utilizes muscle power more efficiently.

The self-feathering blade greatly reduces wrist and forearm fatigue. It also simplifies the mechanics and reduces the cost of the articulating oar.

BRIEF SUMMARY OF THE INVENTION

The Bow Facing Rowing System consists of a fixed seat and a footpad that slide forward and backward. The footpad drives outriggers in the opposite direction of the footpad. Said outriggers can be elevated to accommodate the height of the rower and may also be disconnected in a manner to allow the outrigger to swing lengthways along the boat to accommodate embarkation and debarkation dockside and for ease of transporting the boat overland. Articulating oars are geared and attach to the outriggers at the outboard ends of said outriggers.

The blades of the oars feather automatically during the return stroke due to a torsion spring mounted within the shaft. There is a self-releasing manual locking device that holds the blade in the power position (vertical) during reverse and maneuvering strokes.

Figure 1:
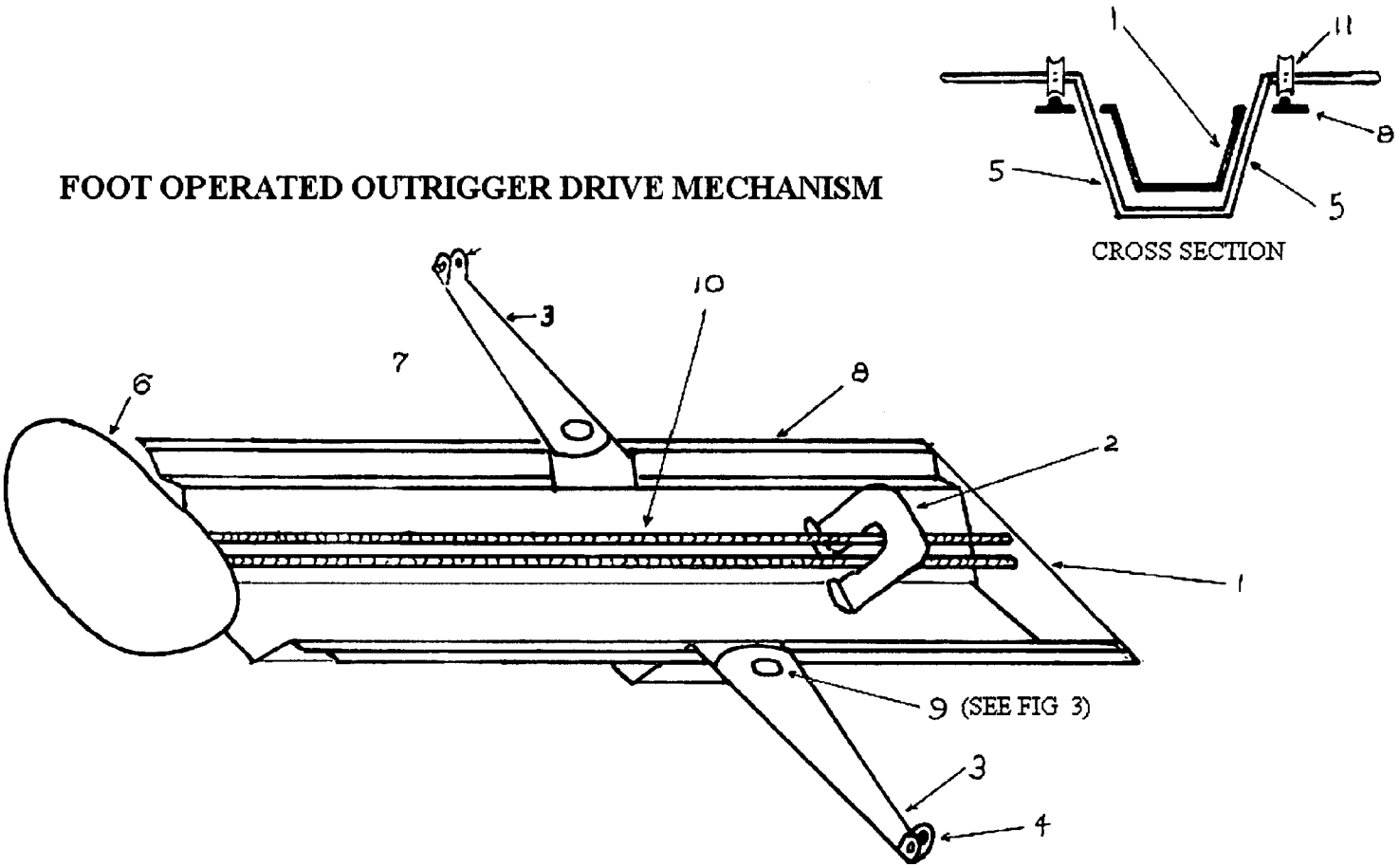
FIG. 1 is an isometric view of the foot operated outrigger drive mechanism.

While the present invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the invention is to cover all modifications, equivalents, and alternatives falling within the spirit of the invention.

| Reference Numerals | |
|---|---|
| 1 | cowling |
| 2 | foot pad |
| 3 | outrigger arm |
| 4 | pinned oar mount |
| 5 | lower member outrigger assembly |
| 6 | fixed seat |
| 7 | foot pad track |
| 8 | outrigger track |
| 9 | elevation and swing mechanism |
| 10 | foot pad rail |
| 11 | sheave |
| 12 | cable |
| 13 | elevator |
| 14 | elevator adjustment knob |
| 15 | swing release pin |
| 16 | hinge pin |
| 17 | hinge |
| 18 | hinge bolt |
| 19 | wing nut |
| 20 | top plate |
| 21 | Teflon washer |
| 22 | bevel gear |
| 23 | blade shaft |
| 24 | bushing |
| 25 | lower plate |
| 26 | bracket mount |
| 27 | oar mount pin |
| 28 | bolt |
| 29 | lock washer |
| 30 | handgrip shaft |
| 31 | blade |
| 32 | torsion spring |
| 33 | bearing |
| 34 | ½ round |
| 35 | 80° round |
| 36 | sleeve |
| 37 | dogging mechanism |
| 38 | cable sleeve |
| 39 | cable |

DETAILED DESCRIPTION

Figure 2:
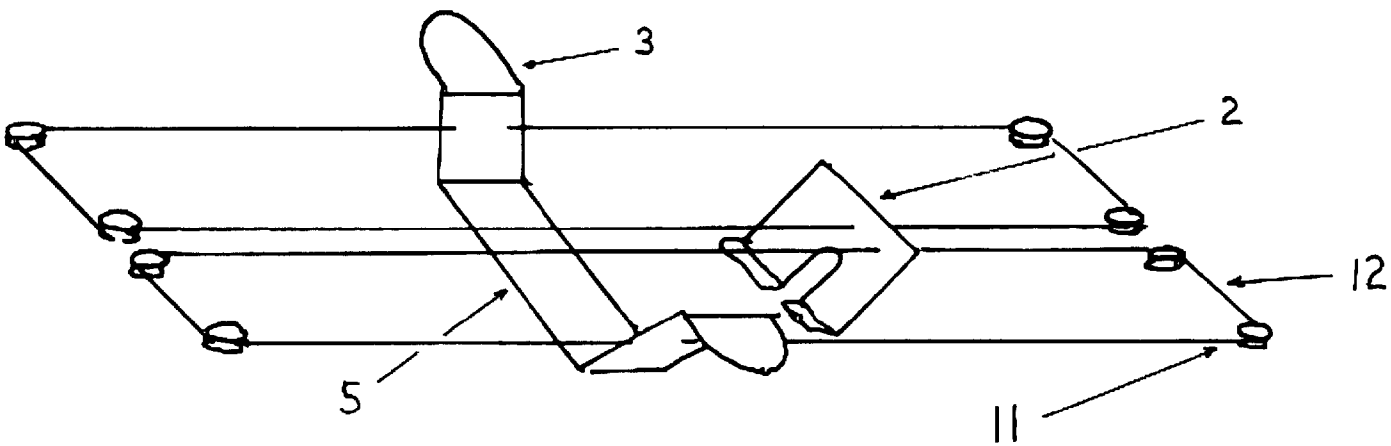
FIG. 2 is an isometric view of the footpad/ outrigger cable system.
Figure 4:
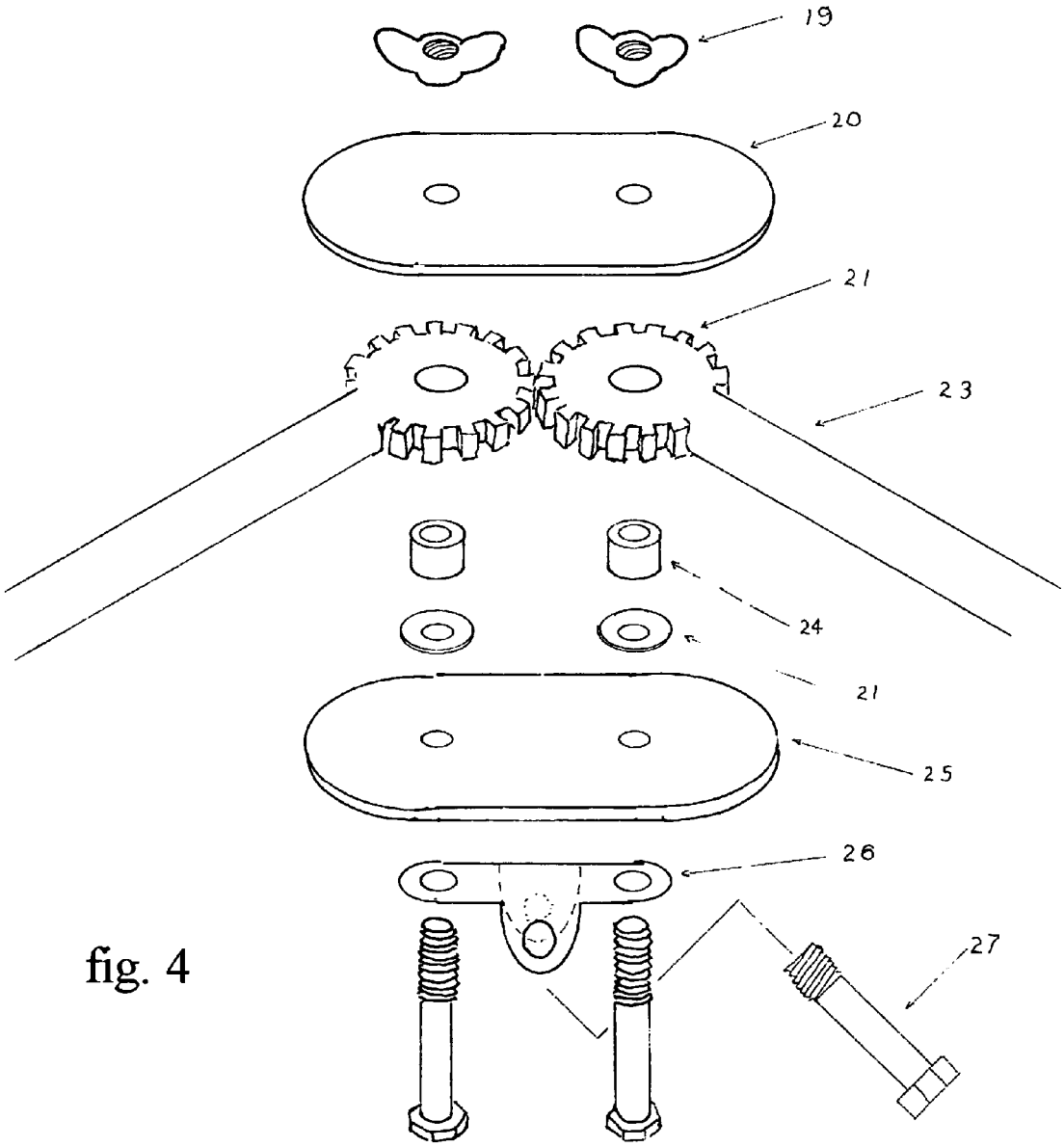
FIG. 4 is an expanded isometric view of the oar-articulating hinge.
Figure 5:
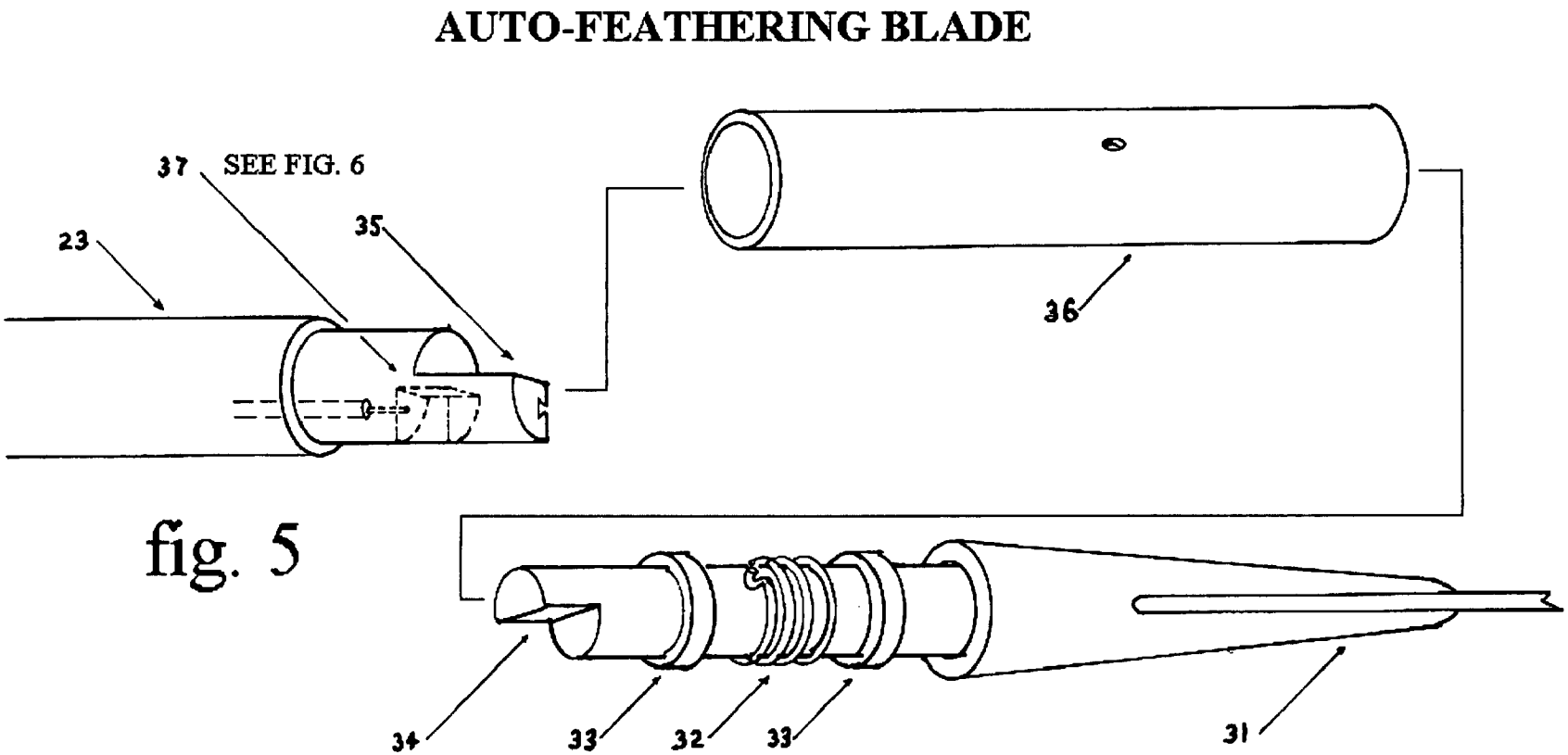
FIG. 5 is an isometric view of the auto-feathering blade.
Figure 6:
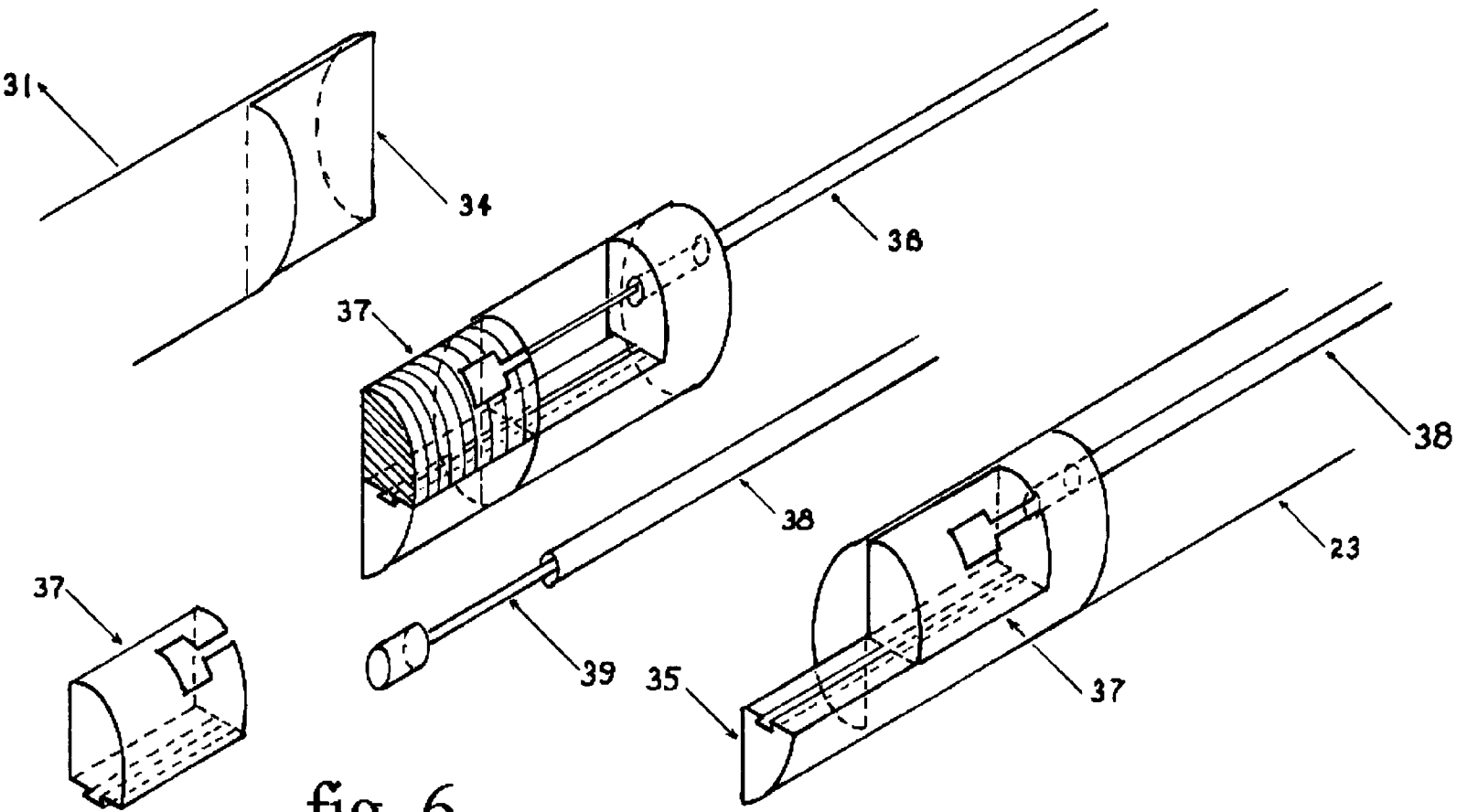
FIG. 6 is an isometric view of the cable activated dogging mechanism.

Bow Facing Rowing System is comprised of the foot operated, outrigger drive mechanism (FIGS. 1 and 2), articulating oars (FIGS. 3 and 4) and self-feathering blade (FIGS. 5 and 6).

Foot operated, outrigger drive mechanism: A molded cowling 1 provides the framework for said mechanism. Tracks 8 are mounted along the port and starboard gunnels on which the lower member of the outrigger assembly 5 rides. The depth of the cowling is about seven inches and is wide enough for both of the rower's feet to be comfortably positioned side by side on the footpad 2. Between the feet is a rail 10 on which the footpad 2 rides. This footpad uses a system of rails and sheaves for minimum friction. A fixed seat 6 is mounted at the rear of the cowling. The lower member of the outrigger assembly 5 is connected to the footpad 2 with a system of sheaves 11 and cables 12 that cause the outrigger 3 to travel in the opposite direction as the footpad 2. Said cables 12 are mounted outside of the cowling 1 and down through the center of the rail 10.

Figure 3:
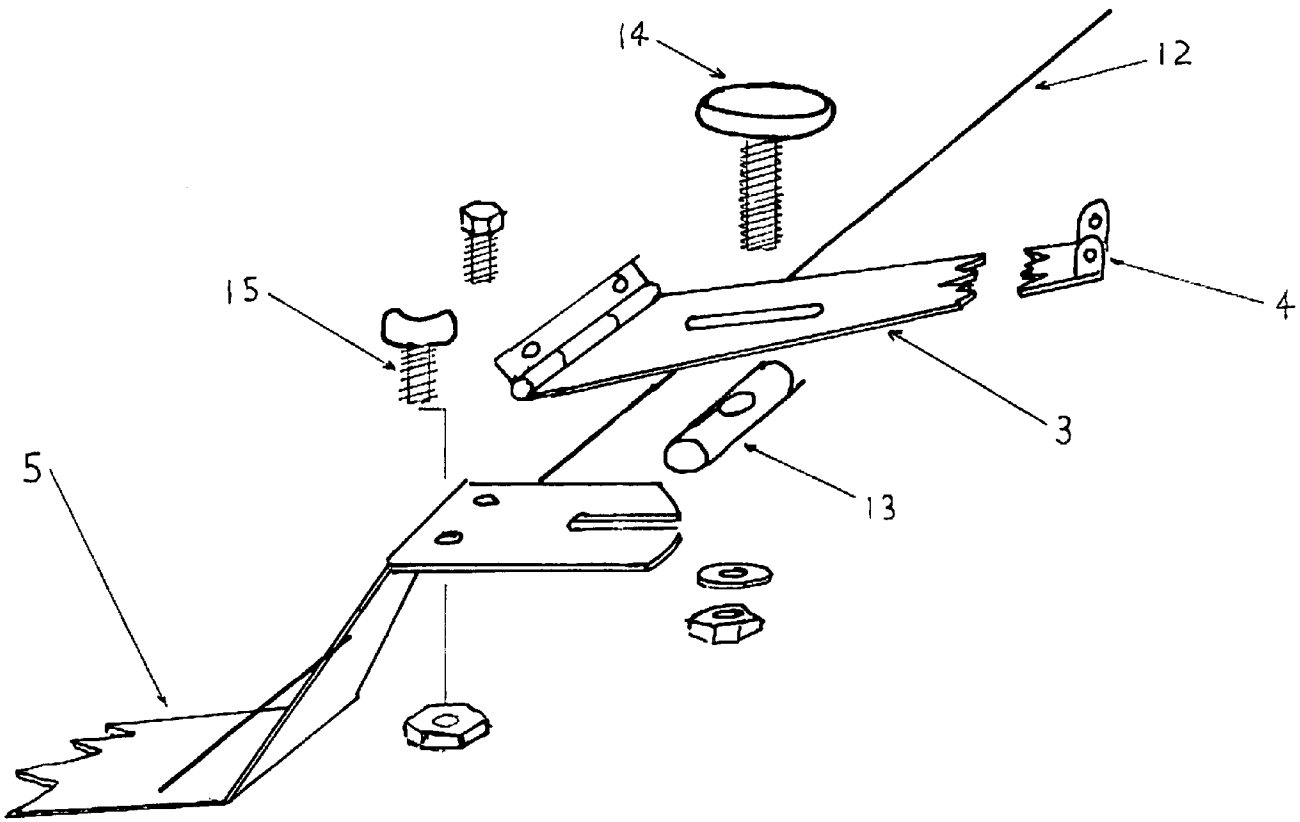
FIG. 3 is and expanded isometric view of the elevation and swing mechanism.

An elevation/swing mechanism FIG. 3 connects the outrigger 3 to the distal ends of the lower member of the outrigger assembly 5. Said connection is made at three points. The inboard end of the outrigger is hinged 9 and the forward part of the hinge is permanently fixed but will allow the outrigger arm 3 to rotate. The after part of said hinge 17 can be firmly attached for rowing and released 15 to allow the outrigger arm to rotate along the length of the boat for ease of docking and overland transportation.

The third point of attachment is through a longitudinal slot in the outrigger arm through which the elevator adjustment knob 14 protrudes downward through the outrigger arm 3, the elevator 13, a slot in the distal end of the lower member of the outrigger plate 5, and a nut beneath. By sliding the elevator adjustment knob 14 inboard, the outrigger arm is raised to accommodate a tall rower. Likewise, it can be lowered by sliding the elevator adjustment outboard for a shorter person.

Articulating Oar: The oar is comprised of four parts; the hand grip shaft 30, bevel gear articulating hinge FIG. 4, oar shaft 23, and blade 31. The oar articulates about a quarter of the way from the handgrip to the blade. A geared hinge 22 allows the oar to sweep in a plane. Said hinge is pinned 27 horizontally to the outboard end of the outrigger 3 along the longitudinal direction of the boat from underneath to allow the angle of the sweep of the oar to be raised or lowered in order to accommodate the power stroke below the surface of the water and the return stroke above the water.

Blade: The blade FIG. 5 of the oar rotates (feathers) automatically from approximately 185 degrees from vertical during the power stroke to approximately 265 degrees from vertical on the return stroke. There is an torsion spring 32 mounted within the shaft that returns the blade to the 265-degree position. Water pressure during the power stroke causes the blade to flip into the power position.

A cable activated dogging mechanism FIG. 6 is built into the auto-rotating device to lock the blade into the power position for reverse and maneuvering strokes. The cable is similar to a bicycle break cable that rides in a sleeve pushing the dogging device into position. Said cable is activated by pressing a thumb-activated plunger. Said flexible cable and sleeve travel through the hollow shaft of the oar and passes over or under the articulating hinge but inside the upper and lower plates of the oar articulating hinge FIG. 4.

Operation

A rower seated on the fixed seat of the Bow-Facing Rowing System will go through the same physical motions used in a conventional sliding seat system. He will raise the handgrips to lower the blades of the oars into the water. His feet will be placed on the footpads. He will simultaneously pull on his arms and push with his feet to propel the boat through the water. At the end of the stroke the rower will push downward on the handgrips to raise the blades out of the water and push the oars away while he draws his legs to his chest, pulling the footpad back with his feet. He is now positioned for another stroke.

For maneuvering and backstroking the feet will remain stationary, which will cause the outriggers to also remain stationary. The rower will then control his craft with the oars alone, without the benefit of leg power. The blades will be locked in their power-stroke position with the cable activated dogging mechanism FIG. 6.

CONCLUSION

The Bow-Facing Rowing System provides a more efficient means of rowing than prior bow facing rowing art. Because the rowers weight is not shifting, a shorter (car-top) boat is feasible. The moving outriggers cause the oars to scribe a shallower arch than the radius scribed by an oar with a fixed outrigger or oarlock thus improving the efficiency of the power stroke. Simplicity of design, combined with the advantage of a forward-facing system will allow this emerging art to compete with other forward facing car-top boats, such as sea kayaks and canoes, as it is inherently faster and a superior form of exercise.

The invention claimed is:

1. A rowing device comprising:

a foot operated outrigger drive mechanism having at least one footpad and a port side outrigger and a starboard side outrigger;

said footpad suitable for pushing with the feet;

wherein the port side outrigger is suitable for being on the port side of a rowboat and the starboard outrigger is suitable for being on the starboard side of said rowboat;

said port side and starboard side outriggers respectively having an outboard end and an inboard end;

said starboard and said port side outrigger mounted in said foot operated outrigger drive mechanism such that the outrigger moves in substantially the opposite direction as the footpad when said footpad is being pushed; said outrigger mounted in said foot operated drive mechanism such that the outrigger moves in substantially the opposite direction as the footpad when said footpad is being pulled.

2. The rowing device of claim 1 further comprising:

said footpad suitable for being slidably mountable in a hull of a row boat so that when one pushes on the footpad with their feet, the rower's body remains in substantially the same position with respect to said hull of said rowboat while propelling the footpad forward with their feet.

3. The rowing device of claim 1 further comprising:

a port side articulating oar attached to said port side outrigger;

a starboard side articulating oar attached to said starboard side outrigger;

said port side articulating oar having a blade shaft and a handgrip shaft wherein said blade shaft and handgrip shaft are attached by an articulating mechanism;

said starboard side articulating oar having a blade shaft and a handgrip shaft wherein said blade shaft and handgrip shaft are attached by an articulating mechanism.

4. The rowing device of claim 2 further comprising:

said articulation of said port side oar being such that when said port side oar handgrip shaft is pulled from bow to stem during the power stroke, the port side oar blade shaft moves substantially longitudinally in the same direction, also from bow to stem;

said articulation of said starboard side oar being such that when said starboard side oar handgrip shaft is pulled from bow to stem during the power stroke, the starboard side oar blade shaft moves substantially longitudinally in the same direction, also from bow to stem;

said articulation of said port side oar and starboard oar being so that when said handgrip segments of the port side and starboard oars are pulled a rower pulling the handgrip segments of the port side and starboard side oars would face the direction the rowboat is moving.

5. The rowing device of claim 3 further comprising:

said articulation of said port side oar being such that when said port side oar handgrip shaft is pushed from stem to bow during the return stroke, the port side oar blade shaft moves substantially longitudinally in the same direction, also from stem to bow;

said articulation of said starboard side oar being such that when said starboard side oar handgrip shaft is pushed from stem to bow during the return stroke, the starboard side oar blade shaft moves substantially longitudinally in the same direction, also from stem to bow.

6. The rowing device of claim 4 further comprising:

said footpad suitable for being slidably mountable in a hull of a row boat so that when one pushes on the footpad with their feet, the rower's body remains in substantially the same position with respect to said hull of said rowboat while propelling the footpad forward with their feet.

7. The rowing device of claim 4 further comprising:

said port side oar's blade shaft having a blade substantially at the outer end for contact with water and propelling a rowboat through water when moved through the water during the power stroke;

said articulation of said port side oar being such that when said port side oar handgrip shaft is pulled from bow to stem during the power stroke, the port side oar blade is substantially perpendicular with the surface of the water so as to maximize the amount of water being pushed by the blade;

said starboard oar's blade shaft having a blade substantially at the outer end for contact with water and propelling a rowboat through water when moved through the water during the power stroke;

said articulation of said starboard oar being such that when said starboard oar handgrip shaft is pulled from bow to stem during the power stroke, the starboard oar blade is substantially perpendicular with the surface of the water so as to maximize the amount of water being pushed by the blade.

8. The rowing device of claim 4 further comprising:

said articulation of said port side oar being such that when said port side oar handgrip shaft is pushed from stem to bow during the return stroke, the port side oar blade shaft is auto-feathered and is substantially parallel with the surface of the water to minimize wind resistance;

said articulation of said starboard side oar being such that when said starboard side oar handgrip shaft is pushed from stem to bow during the return stroke, the starboard side oar blade shaft is auto-feathered and is substantially parallel with the surface of the water to minimize wind resistance.

9. The rowing device of claim 5 further comprising:

said articulation of said port side oar being such that when said port side oar handgrip shaft is pushed from stem to bow during the return stroke, the port side oar blade shaft is auto-feathered and is substantially parallel with the surface of the water to minimize wind resistance;

said articulation of said starboard side oar being such that when said starboard side oar handgrip shaft is pushed from stem to bow during the return stroke, the starboard side oar blade shaft is auto-feathered and is substantially parallel with the surface of the water to minimize wind resistance.

10. The rowing device of claim 6 further comprising:

said articulation of said port side oar being such that when said port side oar handgrip shaft is pushed from stem to bow during the return stroke, the port side oar blade shaft is auto-feathered and is substantially parallel with the surface of the water to minimize wind resistance;

said articulation of said starboard side oar being such that when said starboard side oar handgrip shaft is pushed from stern to bow during the return stroke, the starboard side oar blade shaft is auto-feathered and is substantially parallel with the surface of the water to minimize wind resistance.

11. The rowing device of claim 2 further comprising the port side outrigger being attached to the starboard side outrigger so as to form an outrigger assembly having a port side and a starboard side.

12. The rowing device of claim 1 further comprising the port side outrigger being attached to the starboard side outrigger so as to form an outrigger assembly having a port side and starboard side.

13. The rowing device of claim 3 further comprising the port side outrigger being attached to the starboard side outrigger so as to form an outrigger assembly having a port side and starboard side.

14. The rowing device of claim 4 further comprising the port side outrigger being attached to the starboard side outrigger so as to form an outrigger assembly having a port side and starboard side.

15. The rowing device of claim 5 further comprising the port side outrigger being attached to the starboard side outrigger so as to form an outrigger assembly having a port side and starboard side.

16. The rowing device of claim 8 further comprising the port side outrigger being attached to the starboard side outrigger so as to form an outrigger assembly having a port side and starboard side.

17. The rowing device of claim 9 further comprising the port side outrigger being attached to the starboard side outrigger so as to form an outrigger assembly having a port side and starboard side.

18. The rowing device of claim 4 where the port oar and starboard oar articulation is a bevel gear.

19. The rowing device of claim 7 where the port oar and starboard oar articulation is a bevel gear.

20. The rowing device of claim 9 where the port oar and starboard oar articulation is a bevel gear.

21. The rowing device of claim 12 wherein outrigger assembly is connected to the footpad with a system of one or more sheaves and one or more cables that cause the outrigger assembly to travel in the opposite direction as the footpad.

22. The rowing device of claim 3 wherein port side outrigger and starboard outrigger is connected to the footpad with a system of one or more sheaves and one or more cables that cause the outrigger assembly to travel in the opposite direction as the footpad.

23. The rowing device of claim 9 further comprising:

said port side outrigger and starboard outrigger connected to the footpad with a system of one or more sheaves and one or more cables that cause the outrigger assembly to travel in the opposite direction as the footpad;

a rail upon which the footpad rides so as to slide the footpad back and forth.

24. The rowing device of claim 21 further comprising:

a rail upon which the footpad rides so as to slide the footpad back and forth; said cables being mounted outside of a cowling of a rowboat, and down through the center of the rail.

25. The rowing device of claim 3 so that the point of articulation of the port side oar attaches substantially to the outboard end of the port side outrigger and the point of articulation of the starboard side oar attaches substantially to the outboard end of the starboard side outrigger.

26. The rowing device of claim 6 so that the point of articulation of the port side oar attaches substantially to the outboard end of the port side outrigger and the point of articulation of the starboard side oar attaches substantially to the outboard end of the starboard side outrigger.

27. The rowing device of claim 7 further comprising:

said port side and starboard side oar respectively having a manually operated dogging device to fix the oar blade in a vertical position (perpendicular to the surface of the water) and to turnoff the auto-feathering.

28. The rowing device of claim 9 further comprising:

said port side and starboard side oar respectively having a manually operated dogging device to fix the oar blade in a vertical position (perpendicular to the surface of the water) and to turnoff the auto-feathering.

* * * * *